United States Patent [19]

Vecchio

[11] 3,973,407

[45] Aug. 10, 1976

[54] DRAINAGE SYSTEM

[76] Inventor: Fiore M. Vecchio, 8301-118 Ave., Edmonton, Alberta, Canada

[22] Filed: May 2, 1975

[21] Appl. No.: 573,958

[52] U.S. Cl. ..... 210/136; 210/164; 61/10

[51] Int. Cl.[2] ..... E03F 1/00

[58] Field of Search ..... 61/10, 11, 12, 13; 210/163, 164, 165, 136, 117

[56] References Cited

UNITED STATES PATENTS

| | | | |
|---|---|---|---|
| 540,297 | 6/1895 | Brintnall | 210/165 |
| 1,109,740 | 9/1914 | Dehn | 210/163 |
| 1,648,587 | 11/1927 | Moore | 61/10 X |
| 1,665,104 | 3/1928 | Martienssen | 61/10 |
| 3,774,765 | 11/1973 | Kane et al. | 210/164 |

*Primary Examiner*—Dennis L. Taylor
*Attorney, Agent, or Firm*—Sim & McBurney

[57] ABSTRACT

This invention relates to a drainage system for providing drainage above and below a poured floor. After the sub-soil layer is prepared to receive a poured floor thereover, a conduit is provided in the sub-soil and a floor drain is connected to the conduit. The floor drain has first aperture means opening upwardly and second aperture means opening substantially laterally at a location below the first aperture means. On top of the sub-soil layer there is then provided a relatively liquid-permeable layer such as gravel or coarse sand into which seepage from the sub-soil layer can take place, and thereafter a further layer of relatively liquid-impermeable material such as concrete is provided over the first-mentioned layer.

9 Claims, 6 Drawing Figures

DRAINAGE SYSTEM

This invention relates generally to drainage systems and has to do particularly with a drainage system for poured floors. This invention also relates to the construction of a floor drain particularly suited for use in drainage systems intended for poured floors.

Many conventional multi-layer poured floor systems include between two adjacent layers a sheet of water proofing material, which could typically be a synthetic plastic elastomeric sheeting, for example. The provision of the water-proof sheeting is intended to prevent liquid passage from one of the adjacent layers to the other. The desire may be either to prevent liquid from passing downwardly from an overlying layer to an underlying layer, where it may putrify of stagnate, or to prevent liquid from passing in the upward direction from an underlying layer to an overlying layer, particularly when the underlying layer is in direct communication with the supporting sub-soil in an area where the water table tends to rise dramatically during spring run-off or at other critical times of the year. It would be a self-evident advantage to be able to dispense with the provision of such a water-proofing layer without sacrificing the safety feature which the water-proofing layer represents, and it is with this advantage in mind that the present invention has been developed.

Accordingly, this invention provides a drainage system comprising: a first relatively liquid-permeable layer directly above a supporting sub-soil layer such that seepage from the latter into the former can occur, a second, relatively liquid-impermeable layer overtop said first layer, a floor drain embedded in said layers and having first aperture means opening upwardly through said second layer for draining liquid from above said second layer, and having second aperture means opening into said first layer for draining liquids out of said first layer, and conduit means for ducting away from said floor drain any liquid so drained.

Check-valve means are provided for preventing back-up of drained liquid from the floor drain into the relatively liquid-permeable layer through the second aperture means, and for preventing back-up of drainage liquid from the conduit means upwardly through the first aperture means.

This invention also contemplates a method of providing drainage above and below a poured floor, comprising the steps: preparing a sub-soil layer to receive a poured floor, providing conduit means in said sub-soil and a floor drain connected to said conduit means, the floor drain having first aperture means opening upwardly and second aperture means opening substantially laterally at a location below said first aperture means, providing directly above said sub-soil layer a first, relatively liquid-permeable layer into which seepage from the sub-soil layer can take place, said first layer substantially covering said second aperture means of the floor drain, and providing above said first layer a second, relatively liquid-impermeable layer through which said first aperture means opens.

The floor drain also has check-valve means for preventing back-up of drained liquid from the floor drain into the relatively liquid-permeable layer through the second aperture means, and for preventing back-up of drained liquid from the conduit upwardly through the first aperture means.

This invention also provides a floor drain comprising: a body portion, first aperture means opening upwardly from the body portion, second aperture means opening substantially laterally from the body portion at a location below said first aperture means, downwardly open throat portion below said second aperture means and providing a drainage opening, partition means in said body portion dividing said portion internally into (a) a central compartment having a bottom opening within said throat portion and communicating only with said first aperture means, and (b) an annular compartment surrounding said central compartment and communicating only with said second aperture means, said annular compartment having means defining a lower outlet adjacent the bottom opening of said central compartment, a main check-valve in said bottom opening for allowing downward but restraining upward passage of liquid, the said lower outlet of said annular compartment opening into said central compartment above said main check-valve, and at least one auxiliary check-valve within said annular compartment, adapted to allow liquid to move from the second aperture means to said lower outlet, and to restrain liquid movement in the reverse direction.

Four embodiments of this invention are illustrated in the accompanying drawings, in which like numerals denote like parts throughout the several views, and in which.

Figure 1:
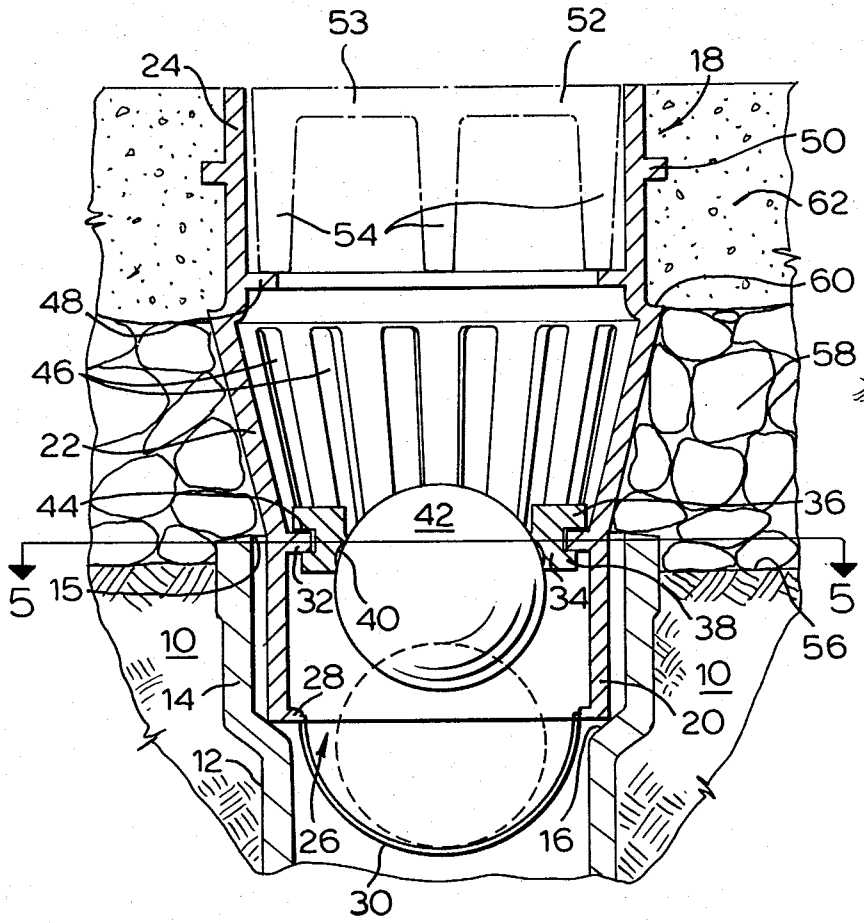
FIG. 1 is an axial vertical sectional view of the first embodiment of this invention.

Attention is first direction to FIG. 1, which illustrates a sub-soil layer 10 in which the upper end 12 of a conventional drainage trap is embedded. As can be seen, the end 12 of the trap terminates in an expanded portion 14 having an open upper end 15, and defining an internal, inward ledge 16 at its lower end.

Received within the expanded portion 14 of the upper end of the trap is a floor drain fixture 18 which includes a lower cylindrical portion 20 received within the expanded portion 14 and resting against the ledge 16, an upwardly and outwardly diverging frusto-conical portion 22 directly above the lower portion 20, and an upper cylindrical portion 24 directly above the frusto-conical portion 22.

The lower cylindrical portion 20 defines a drain opening 26 at its lower end, around which a relatively small inward flange 28 is provided. Wires or thin rods 30 are provided with their ends attached to the flange 28, the wires looping downwardly to define a retaining basket the purpose of which will subsequently be described.

Figure 5:
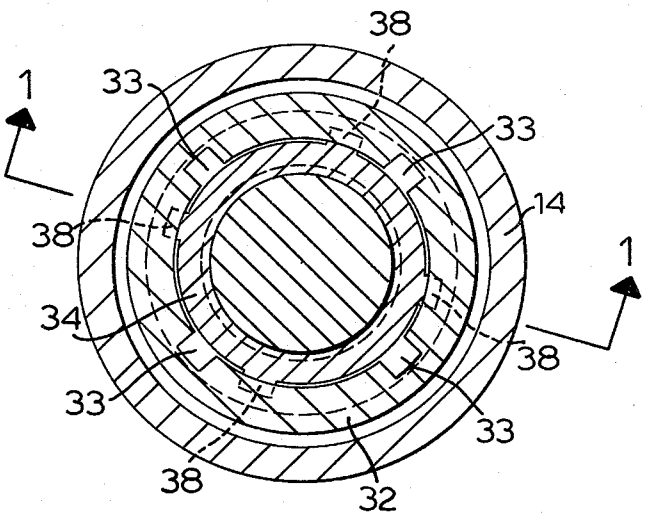
FIG. 5 is a horizontal sectional view taken at the line 5—5 in FIG. 1.

Adjacent the junction between the lower cylindrical portion 20 and the frusto-conical portion 22 is an inwardly projecting flange 32 integral with the cylindrical portion 20. As can be seen in FIG. 5, the flange 32 is interrupted at four spaced locations by recesses 33. An annular valve seat member 34 is provided, having an upper outward flange 36 adapted to be located above the inward flange 32, and having at appropriately spaced intervals four outwardly projecting teeth 38, which permit a bayonet-type connection between valve seat member 34 and the inward flange 32. As seen in FIG. 1, the valve seat member 34 defines a rounded and slightly dished valve seat 40 against which a ball-type float valve 42 is adapted to close. In FIG. 1, the float valve 42 is shown in its closed position in solid lines, and in its open position in broken lines. In the open position, the float valve 42 is limited in its downward movement by the presence of the wires or rods 30 forming a restraining basket.

Located between the upper outward flange 36 of the valve seat member 34 and the inward flange 32 integral with the lower cylindrical portion 20 is an annular gasket member 44 which may be of any suitable gasket material. The distance between the upper outward flange 36 and the teeth 38 of the valve seat member 34 would be arranged in such a way that when the valve seat member 34 is in place as shown in FIG. 1, the gasket member 44 would be under a degree of compression sufficient to provide a good liquid-tight seal between the two members.

As best seen in FIG. 1, the frusto-conical portion 22 of the floor drain fixture 18 is provided with a plurality of spaced, upwardly elongated openings 46, these extending over substantially the whole length of the frusto-conical portion 22.

The upper cylindrical portion 22 of the floor drain fixture 18 has a lower, inwardly extending annular flange 48, and an intermediate outwardly extending annular flange 50. The inwardly extending annular flange 48 is provided for the purpose of supporting a standard grating member 52, which has been shown in broken lines in FIG. 1. The grating member 52 would preferably be sized so as to fit easily within the open upper end of the upper cylindrical portion 24, and may be provided with a slight taper as seen in FIG. 1. The grating member 52 includes an upper portion 53 adapted to rest level with the top of the upper cylindrical portion 24, and downwardly depending legs 54 which are adapted to rest upon the inwardly extending annular flange 48.

The outwardly extending annular flannge 50 is provided to help anchor the floor drain fixture 18 into a surrounding poured concrete layer, as will hereinafter appear.

In accordance with the inventive method for providing drainage both above and below a poured floor, the usual steps would include first preparing a sub-soil layer to receive a poured floor. In FIG. 1, the sub-soil layer 10 is shown to have an upper surface 56 through which the expanded portion 14 at the upper end 12 of the trap protrudes to a slight extent. The sub-soil layer may typically be clay, sand, till or the like, depending upon the sub-surface characteristics in the local area.

After installing the trap in the manner described, with the drain conduit from the trap preferably buried in and enclosed by the sub-soil layer, the floor drain fixture 18 would be inserted in the open upper end 15 of the trap to the position shown in FIG. 1. Next, a first, relatively liquid-permeable layer 58 is provided directly above the sub-soil layer 10, such that liquid seepage from the sub-soil layer 10 may take place into the relatively liquid-permeable layer 58. In the embodiment shown in FIG. 1, the first, relatively liquid-permeable layer 58 consists of coarse gravel, which may be what is known as 1 inch gravel. The first, relatively liquid-permeable layer 58 has sufficient depth to substantially cover all of the openings 46 in the frusto-conical portion 22 of the floor drain fixture 18, and thus extends up to substantially the upper boundary of the portion 22, which in FIG. 1 is clearly defined by a narrow outwardly extending shelf 60, which is the result of the upper cylindrical portion 24 being inwardly offset from the upper end of the frusto-conical portion 22.

Subsequent to the provision of the first, relatively liquid-permeable layer 58, there is provided a second, relatively liquid-impermeable layer 62 which extends from substantially the level of the shelf 60 up to the top of the upper cylindrical portion 24. Thus, the second, relatively liquid-impermeable layer 62 has its upper surface substantially aligned with the top of the portion 24, the latter defining the primary drainage opening adapted to receive liquid running along the upper surface of the layer 62.

It will now be appreciated that the annular flange 50, located at an intermediate position on the upper cylindrical portion 24, serves the function of securely anchoring the floor drain fixture 18 with respect to the second, relatively liquid-impermeable layer 62. The shelf 60 also helps in the anchoring function.

The layer 62 may typically be poured concrete having the standard characteristics found in traffic slabs for poured floor constructions.

The way in which the structure of FIG. 1 provides for drainage of liquid both above and below the poured floor, and also prevents back-up of liquid from the drainage conduit and trap into the area beneath the relatively liquid-impermeable layer 62, will now be described.

Considering first the normal function of the floor drain fixture, it will be appreciated that whenever a liquid such as water is spilled onto the upper surface of the layer 62, it may pass to the location of the fixture, and be drained downwardly through the primary drainage opening defined by the upper cylidrical portion 24, passing downwardly through the fixture 18, and into the upper end 12 of the drainage trap. It is assumed that the level of liquid within the trap is below the position of the wires or rods 30, which would normally be the case, and if so the float valve 42 would be located at its lowermost position shown in broken lines in FIG. 1. Thus, the float valve 42 would not impede downward passage of drained liquid from the floor drain fixture 18 into the trap.

The second situation to be considered arises when liquid seeps upwardly through the sub-soil layer 10 and into the relatively liquid-permeable layer 58 of gravel, for example due to an increase in the water table height at spring run-off. If this should occur, the relatively water-permeable layer 58 will function as a conduit communicating through openings 46 with the interior of the floor drain fixture 18. The seepage water would pass through the openings 46, and then downwardly past the float valve 42 into the trap, from where it may be ducted away into the usual sewage lines, etc. Again it is assumed in this situation that the level of water in the trap is not high enough to close the float valve 42 against its seat 40; in other words it is assumed that the sewage conduit leading away from the trap is clear and not clogged.

The third situation to be considered is that which arises when the sewage conduit from the trap is clogged and incapable of ducting sewage liquid into a sewage line. When this happens, the level of liquid in the upper and 12 of the trap will rise, carrying the float valve 42 up and into its valve seat 40. The float valve 42 will thus function as a check-valve preventing liquid from passing upwardly out of the trap and into the floor drain fixture 18. Thus the provision of the float valve 42 ensures that liquid from the sewage conduit will neither enter the relatively liquid-permeable layer 58, nor pass upwardly through the floor drain fixture 18 onto the upper surface of the relatively liquid-impermeable layer 62.

Figure 2:
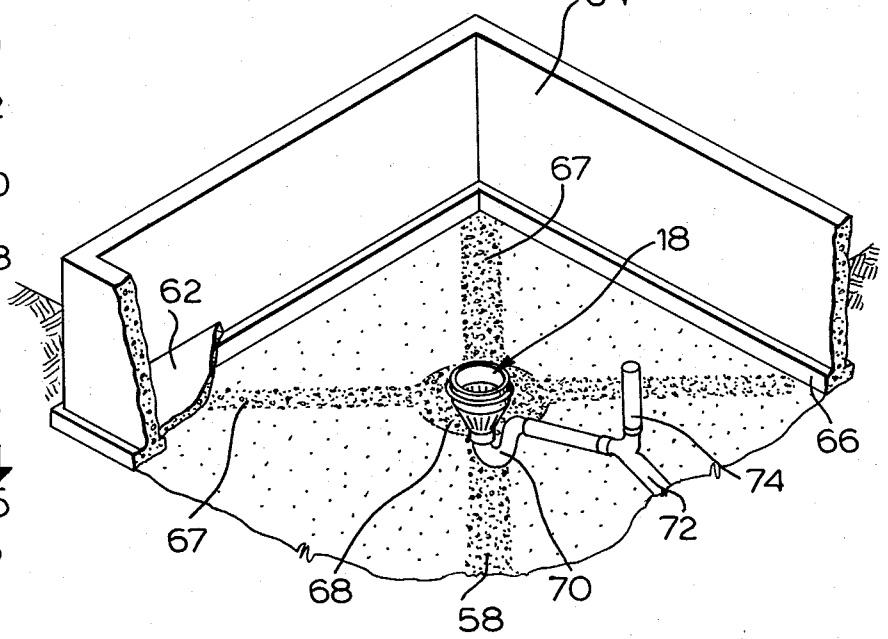
FIG. 2 is a partly broken away perspective view of a composite poured floor with the floor drain of FIG. 1 in place.

Attention is now directed to FIG. 2 which shows a preferred configuration for the distribution of two different relatively water-permeable materials in the layer 58, with respect to the floor drain fixture 18. In FIG. 2, a building foundation wall 64 has the usual sub-soil footing 66. The upper, relatively liquid-impermeable layer 62 is shown broken-away at the left in FIG. 2, and the main portion of the floor area in the figure illustrates a preferred distribution of two materials constituting the first, relatively liquid-permeable layer 58, these materials being coarse sand and gravel. The gravel is shown to be distributed in an X-formation, with the two crossed arms of the "X" meeting centrally of the floor area, which is where the floor drain fixture 18 is located. As seen, the arms 67 of the "X" are arranged diagonally with respect to the floor area, and where they intersect there is an enlarged gravel area 68 which encircles the floor drain fixture 18. Elsewhere in the floor area, i.e. between the arms 67 of the "X", there is provided coarse sand. Both the sand and the gravel are filled in to substantially the same level, this being roughly the height of the ledge 60 seen in FIG. 1.

The coarse sand is not as liquid-permeable as the gravel, but it is sufficiently permeable for the intended purpose, and is capable of permitting seepage water to flow to one or other of the arms 67 of the "X", and thence to the floor drain fixture 18.

Also shown in FIG. 2 is a standard drainage trap 70, a sewage conduit 72, and a breather pipe 74.

Figure 3:
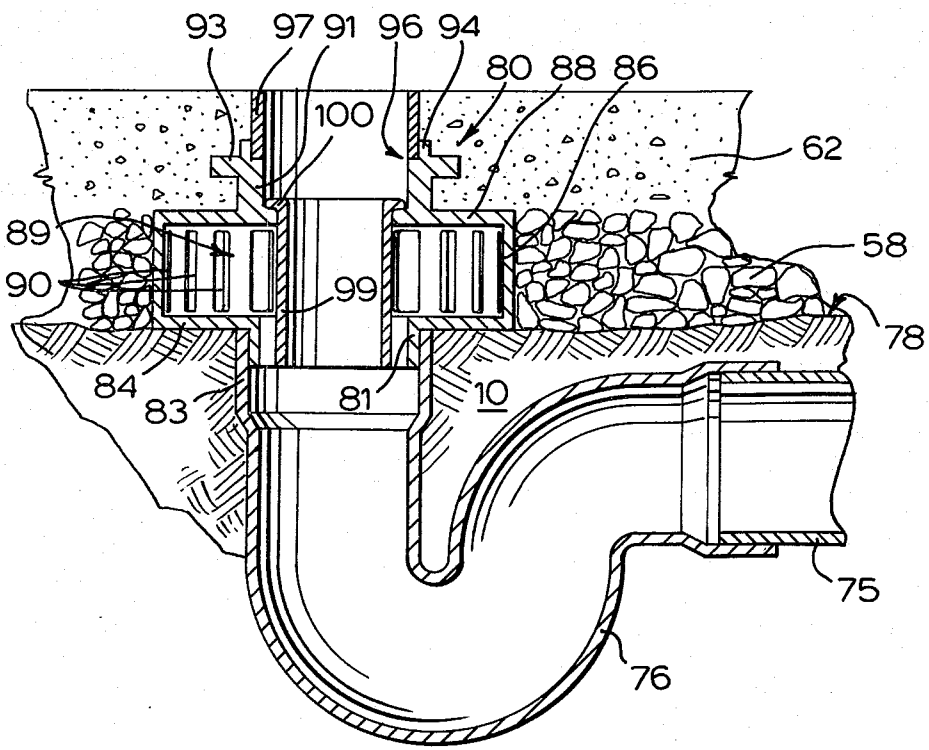
FIG. 3 is a vertical axial sectional view of the second embodiment of this invention.

Attention is now directed to FIG. 3, which illustrates the second embodiment of this invention.

In FIG. 3, the end of a typical sewage conduit 75 is shown connected to a conventional trap 76, both of which are embedded in a sub-soil layer 10 having an upper surface 78. A floor drain fixture 80 has a lower cylindrical portion 81 telescopingly inserted into the upper end portion 83 of the trap 76. Integral with the lower cylindrical portion 81 is an outwardly extending annular wall 84, which in turn is integral with an upstanding cylindrical wall 86 of larger diameter than the portion 81. The cylindrical wall 86 is in turn integral with a further annular wall 88. The annular walls 84, 88 and the cylindrical wall 86 together define a substantially cylindrical chamber 89. The cylindrical wall 86 includes a plurality of vertically elongated openings 90 at regularly spaced intervals around the wall.

Extending upwardly from the inner region of the annular wall 88 is an upper cylindrical portion 91 which includes an outwardly extending flange 93 and an upwardly extending ridge 94. The inner surface of the ridge 94 is outwardly offset from the main part of the upper cylindrical portion 91, and thus defines an inwardly extending ledge at the location identified by the arrow 96. A separate collar member 97 is sized to fit snugly but slidably within the ridge 94 and against the ledge at the location 96. By making the collar member 97 a separate component, the vertical height between the upper annular wall 88 and the upper edge of the collar member 97 can be altered by replacing the collar member 97 with one having a different axial dimension.

Located telescopingly and slidably inside the floor drain fixture 80, and forming a part thereof, is a sleeve member 99 which includes an outward flange 100 at its upper end, the outward flange being adapted to rest against the inner edge of the upper annular wall 88. The sleeve member 99 in the embodiment shown in FIG. 3 extends to a location substantially level with the bottom of the lower cylindrical portion 81.

The method steps in the formation of the poured floor for the embodiment of FIG. 3 are essentially the same as those described earlier for the first embodiment. A first, relatively liquid-permeable layer 58 is placed above the sub-soil layer 10, up to substantially the level of the uppermost annular wall 88 of the fixture 80. As seen in FIG. 3, the layer 58 consists of coarse gravel, the interstices of which communicate directly with the sub-soil layer 10, thereby permitting seepage of liquid from one into the other.

Overtop the first layer 58 is poured a second, relatively liquid-impermeable layer 62, which typically would be of a concrete suitable to constitute the traffic slab of a poured floor construction. As can be seen, the second layer 62 is made to be level or substantially so with the top of the collar member 97.

In the embodiment of FIG. 3, a grating member similar to the grating member 52 shown in FIG. 1 would be provided, although such has been illustrated in FIG. 3.

A particular advangage inherent in the second embodiment of this invention relates to the relatively large diameter of the cylindrical chamber 89 which communicates with the first, relatively liquid-permeable layer 58 through the openings 90. The relatively increased size of the cylindrical wall 86 containing the openings 90 ensures that liquid will pass readily from the layer 58 to the interior of the floor drain fixture 90. It will now be realized that one of the functions of the sleeve member 99 is to encourage liquid entering the cylindrical chamber 89 from the layer 58 to pass downwardly between the sleeve member 99 and the lower cylindrical portion 81 into the trap 76. Another function of the sleeve member 99 is to reduce the likelihood that fumes or offensive odours from seepage liquid entering the chamber 89 from the layer 58 will be able to pass upwardly to the area above the surface of the second layer 62.

It is pointed out that the second embodiment of this invention illustrated in FIG. 3 does not include a check-valve arrangement per se. It will be appreciated, however, that even should there be a brief period during which sewage water backs up from the trap 76 and into the relatively liquid-permeable layer 58, the same will eventually drain out of the layer 58 again, when the trap or the sewage conduit 75 has been cleared. The general layer 58 would also be subsequently cleansed to some extent by the flushing action taking place the next time that seepage from the sub-soil layer 10 passes into the layer 58 and thence into the floor drain fixture 80.

If the fit between the sleeve member 99 and the inner margin of the uppermost annular wall 88 is made sufficiently tight, the sleeve member 99 can function to some extent to prevent excessive back-up of sewage liquid from the trap 76 into the layer 58. This restraint would arise due to the fact that the presence of the sleeve member 99, once the level of the liquid in the trap 76 has risen above the bottom end of the sleeve member 99, would effectively prevent the air in the interstices between the individual gravel stones from passing out of the floor drain fixture 80 to make room for the back-up liquid from the trap 76. Thus, there would be created a pressure head having a pressure greater than atmospheric, which would tend to restrain the entry of liquid from the trap 76 into the layer 58.

Figure 4:
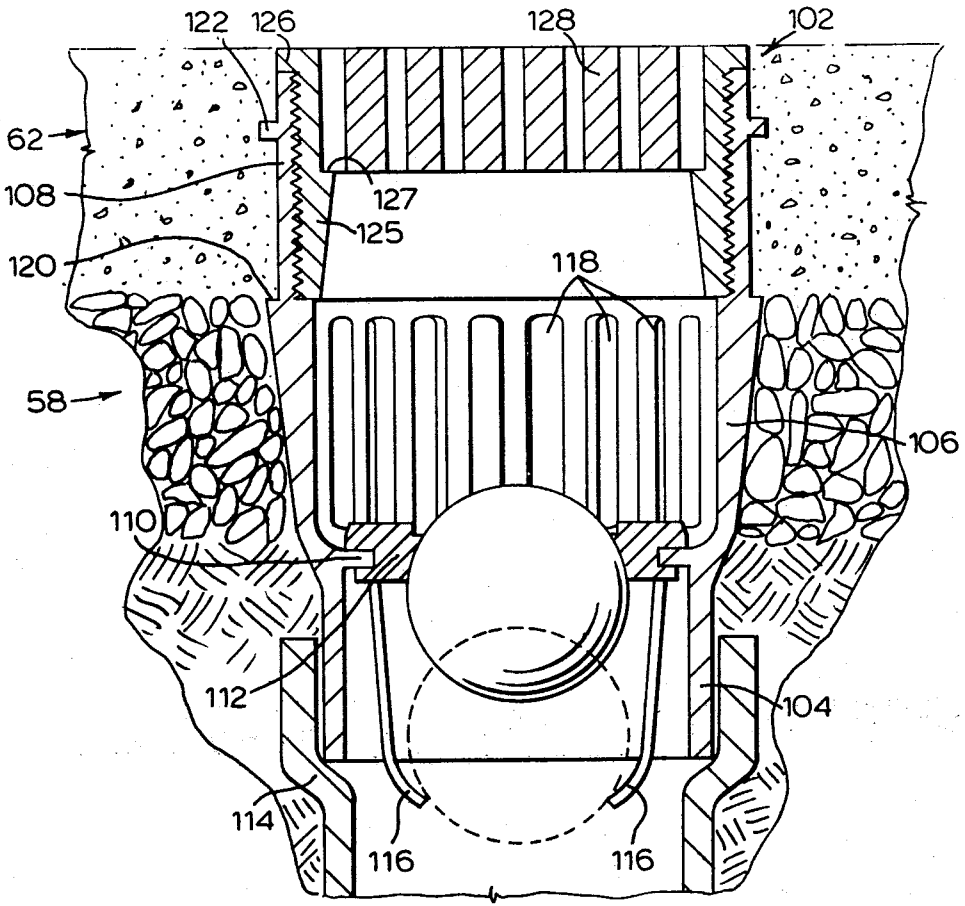
FIG. 4 is a vertical axial sectional view of the third embodiment of this invention.

Attention is now directed to FIG. 4, which illustrates the third embodiment of this invention. In FIG. 4, the floor drain fixture 102 is seen to include the lower cylindrical portion 104, an intermediate frusto-conical portion 106, and an upper cylindrical portion 108. Located at the top of the lower cylindrical portion 104 is an inwardly extending flange 110 which is adapted to cooperate with a valve seat member 112 by way of bayonet-type connection essentially identical to that shown for the first embodiment in FIGS. 1 and 5. Because the one way check-valve in FIG. 4 constituted by the valve seat member 112 and its related components is essentially identical to that described earlier for the first embodiment of this invention, the same will not be dealt with in detail again. It may be noted, however, that whereas the FIG. 1 embodiment includes a basket-type retaining structure constituted by rods or wires 30 which are attached to the lower cylindrical portion of the floor drain fixture, in the FIG. 4 embodiment the means restraining the ball from passing downwardly into the trap 114 is constituted by a plurality of downwardly extending and inwardly curved fingers 116 which are attached directly to the valve seat member 112 itself.

The frusto-conical portion 106 is provided with a plurality of vertically elongated openings 118 for the purpose of providing communication between the interior of the floor drain fixture 102 and the interstices between the gravel stones in the first, relatively liquid-permeable layer 58.

The upper cylindrical portion 108 is firstly inwardly offset from the upper end of the frusto-conical portion 106, thereby to define an outwardly extending ledge 120 which is intended to aid in the anchoring of the floor drain fixture 102 with respect to the second, relatively liquid-impermeable layer 62. At an intermediate location on the exterior of the upper cylindrical portion 108 is an outwardly extending flange 122 which is also useful in the anchoring of the floor drain fixture 102 with respect to the layer 62.

As seen in FIG. 4, the internal surface of the upper cylindrical portion 108 is threaded for the reception of an externally threaded collar member 125 which has an outwardly extending flange 126 at its upper end, and which is shaped to define an inwardly extending ledge 127 at an intermediate location. The ledge 127 is intended to receive and support a conventional removable grating member 128 of which the upper surface is flush with the upper end of the collar member 125.

It will be appreciated that the distance between the ledge 120 and the upper end of the collar member 125 can be adjusted by rotating the collar member 125 with respect to the floor drain fixture 102, thereby screwing the same upwardly or downwardly.

Figure 6:
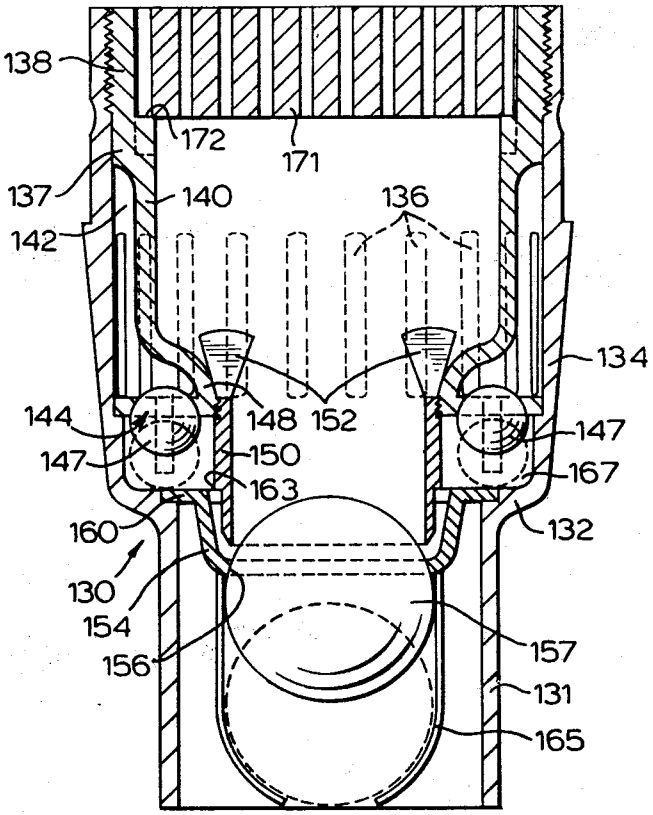
FIG. 6 is a vertical axial sectional view of the fourth embodiment of this invention.

Attention is now directed to FIG. 6, in which the fourth embodiment of this invention is shown in axial section. In the fourth embodiment, the floor drain fixture 130 can be seen to include a downwardly extending neck portion 131 open at the bottom, an outward step 132 at the upper end of the neck portion, and a generally upwardly extending cylindrical body portion 134 extending upwardly from the step 132. At an intermediate location along its length, the body portion 134 has a plurality of vertically elongated, circumferentially spaced openings 136 provided for the same purpose as the similar vertically elongated openings in the previously described embodiments. As seen in FIG. 6, there is provided an internal wall member 137 which includes an upper portion 138 having external threads adapted to engage internal threads at the upper end of the body portion 134, and a partitioning wall 140 which is spaced inwardly from the wall defined by the body portion 134, thereby to define an annular chamber 142 which communicates with the openings 136. The annular chamber 142 is closed except for the openings 136 and except for two antipodally located check-valve openings 144, in association with which two one-way valve means are provided. As can be seen in the figure, each of the check-valve openings 144 is in the shape of a spherical valve seat, which is adapted to receive one of two spherical ball valve member 147. The ball valve members 147 are adapted to move substantially in a vertical direction between a closed position as shown in solid lines in FIG. 6, and an open position as shown in broken lines in FIG. 6. The ball valve member 147 are arranged such as to permit liquid to flow downwardly through the respective check-valve opening 144 out of the annular chamber 142, but restrain upward flow of liquid through the check-valve openings 144 and into the annular chamber 142.

As can be seen, the internal wall member 137 has an inwardly extending shoulder portion 148 on the inner lower corner of which threads are provided. The fourth embodiment of this invention includes an interior collar member 150 which includes external threads at its upper portion, the latter threads being engageable with the threads on the shoulder portion 148, as shown. THe interior collar member 150 also includes integral upstanding wing members 152, the purpose of which is to afford a grip location, by which the interior collar member 150 can be screwed downwardly into the position shown, by reaching a hand from the top downwards. Because of the substantially tight engagement between the interior collar member 150 and the shoulder portion 148 of the internal wall member 137, it will be appreciated that liquid flowing downwardly through the check-valve openings 144 will be constrained to enter the main central throat area of the fixture 130 at a location below the interior collar member 150. As seen in the figure, the construction of the fourth embodiment also includes a further valve seat member 154, which defines a central valve seat 156 adapted to receive a spherical ball valve 157. The ball valve 157 is shown in its closed position in solid lines and in its open position in broken lines in the figure. The valve seat member 154 also includes a flange portion 160 which has an outwardly extending part adapted to lodge in a corner ledge defined at the step 132, and a periodically interrupted inward portion adapted to be located below a step 163 at the outer lower surface of the interior collar member 150. As will be appreciated, the securement of the interior collar member 150, and the respective locations of the steps defined by the interior collar member 150 and by the step 132 will ensure that the valve seat member 154 is retained in the position shown. The interior collar member 150 prevents upward movement of the valve seat member 154, and the ledge defined by the step 132 prevents downward movement thereof.

The valve seat member 154 further includes downwardly extending and inwardly curving wire-like fingers 165 which act to limit the downward movement of the ball valve 157.

The particular section shown in FIG. 6 is taken to pass through two of the periodic interruptions in the inwardly extending part of the flange portion 160 of the valve seat member 154, and it will thus be seen that a passage is provided for liquid to pass from the annular space 167 immediately below the check-valve openings 144, into the central throat portion of the fixture. Such passage requires that the liquid move downwardly in the annular channel defined between the interior collar member 150 and the valve seat member 154.

The fixture construction shown in FIG. 6 also includes a standard grating member 171, which is adapted to rest on an internal ledge 172 provided on the internal wall of the internal wall member 137.

A further modification may also be made to the embodiment shown in FIG. 6 of the drawings. This modification would involve providing two antipodally arranged openings in the interior collar member 150 to provide a passage for liquid out of the annular space 167 and into the main central portion of the floor drain, from where it would pass downwardly past the ball valve 157 and into the drain pipe. These antipodally arranged openings would replace the annular channel as shown in FIG. 6, this being defined between the lower end of the interior collar member 150 and the valve seat member 154. The further modification would also involve the provision of an additional rotary collar member inside but immediately adjacent the interior collar member 150, the rotatable collar member having means by which it can be manually rotated from above, after removal of the grating member 171. The rotatable collar member would be provided with matching antipodally arranged openings such that, when the rotatable collar member is in one position with respect to the interior collar member 150, all of the openings would be in registry and liquid could pass from the annular space 167 to the central portion of the floor drain, and such that, when the rotatable collar member was in another position spaced angularly from the first-mentioned position, all openings would be out of registry, and the annular space 167 would be effectively sealed from the interior of the floor drain. The latter position would suffice to prevent soap or detergent suds from passing upwardly from the drain pipe in a back-up situation and entering the space between the sub-soil layer and the upper, relatively liquid-impermeable layer. It will be understood that, whereas liquid attempting to back up into the space beneath the relatively liquid-impermeable layer would cause the ball valve members 147 to close, thus effectively preventing such penetration. However, soap suds are much lighter, and would not be able to "float" the ball valve members 147 up into the "closed" condition.

I claim:

1. A floor drain comprising:

a body portion, first aperture means opening upwardly from the body portion, second aperture means opening substantially laterally from the body portion at a location below said first aperture means, a downwardly open throat portion below said second aperture means and providing a drainage opening, partition means in said body portion dividing said portion internally into (a) a central compartment having a bottom opening within said throat portion and communicating only with said first aperture means, and (b) an annular compartment surrounding said central compartment and communicating only with said second aperture means, said annular compartment having means defining a lower outlet adjacent the bottom opening of said central compartment, a main check-valve in said bottom opening for allowing downward but restraining upward passage of liquid, the said lower outlet of said annular compartment opening into said central compartment above said main check-valve, and at least one auxiliary check-valve within said annular compartment, adapted to allow liquid to move from the second aperture means to said lower outlet, and to restrain liquid movement in the reverse direction.

2. The invention claimed in claim 1, in which said second aperture means includes a plurality of adjacent, vertically elongated openings, and in which there are two auxiliary check-valves within said annular compartment.

3. The invention claimed in claim 1, in which means are provided for selectively manually opening and closing said lower outlet.

4. The invention claimed in claim 1, in which the body portion is provided with an outwardly extending annular ledge above said second aperture means, to permit the floor drain to be securely anchored into a poured floor area.

5. A drainage system which includes a first, relatively liquid-permeable layer directly above a supporting sub-soil layer such that seepage from the latter into the former can occur; a second, relatively liquid-impermeable layer overtop said first layer; a floor drain embedded in said layer; and a conduit means for ducting liquid away from said floor drain;

said floor drain comprising:

a. a body portion, b. first aperture means opening upwardly from the body portion through said second layer for draining liquid from above said second layer, c. second aperture means opening substantially laterally from the body portion at a location below said first aperture means and being aligned and in communication with said first layer for draining liquid out of said first layer, d. a downwardly open throat portion below said second aperture means and providing a drainage opening connected to said conduit means, e. partition means in said body portion dividing said portion internally into (1) a central compartment having a bottom opening within said throat portion and communicating only with said first aperture means, and (2) an annular compartment surrounding said central compartment and communicating only with said second aperture means, said annular compartment having means defining a lower outlet adjacent the bottom opening of said central compartment, f. main check-valve in said bottom opening for allowing downward but restraining upward passage of liquid, the said lower outlet of said annular compartment opening into said central compartment above said main check-valve, g. and at least one auxiliary check-valve within said annular compartment, adapted to allow liquid to move from the second aperture means to said lower outlet, and to restrain liquid movement in the reverse direction.

6. The invention claimed in claim 5, in which said first layer includes first regions of relatively greater liquid-permeability, and second regions of relatively lesser liquid-permeability, said first regions communicating directly with said second aperture means.

7. The invention claimed in claim 6, in which said first regions contain gravel and said second regions contain coarse sand, the floor drain being located within one of said first regions.

8. The invention claimed in claim 6, in which said first regions extend generally radially away from said floor drain.

9. The invention claimed in claim 7, in which said second aperture means includes a plurality of elongated openings sufficiently narrow to prevent passage of the gravel.

* * * * *